US005716511A

United States Patent [19]

Melody et al.

[11] Patent Number: 5,716,511

[45] Date of Patent: Feb. 10, 1998

[54] ANODIZING ELECTROLYTE AND ITS USE

[75] Inventors: Brian John Melody, Greenville; John Tony Kinard, Simpsonville; David Alexander Wheeler, Williamston, all of S.C.

[73] Assignee: Kemet Electronics Corporation, Greenville, S.C.

[21] Appl. No.: 692,221

[22] Filed: Aug. 7, 1996

[51] Int. Cl.[6] ..... C25D 11/04; C25D 11/08; C25D 11/06; H01B 1/00

[52] U.S. Cl. ..... 205/324; 205/325; 205/329; 205/332; 252/500

[58] Field of Search ..... 205/316, 318, 205/322, 324, 325, 329, 332; 252/500

[56] References Cited

U.S. PATENT DOCUMENTS

| | | | |
|---|---|---|---|
| 2,882,233 | 3/1956 | Otley | 252/62.2 |
| 3,359,191 | 12/1967 | Osaka | 204/38 |
| 3,864,219 | 2/1975 | Dosch | 204/33 |
| 3,943,041 | 3/1976 | Jackson | 204/56 R |
| 4,131,520 | 12/1978 | Bernard | 204/42 |
| 4,692,224 | 9/1987 | Bernard | 204/56.1 |
| 4,975,806 | 12/1990 | Clouse | 361/505 |
| 5,211,832 | 5/1993 | Cooper | 205/322 |

FOREIGN PATENT DOCUMENTS

| | | |
|---|---|---|
| 449619 | 7/1948 | Canada . |
| 7-65624 | 3/1995 | Japan . |
| 112062 | 8/1962 | Pakistan . |
| 2 168 383 | 6/1986 | United Kingdom . |

OTHER PUBLICATIONS

Melody, "An Improved Series of Electrolytes for Use in the Anodization of Tantalum Capacitor Anodes," Presented at the Capacitor and Resistor Technology Symposium (C.A.R.T.S. 192), Mar. 17, 1992, Sarasota, FL.

*Primary Examiner*—Kathryn L. Gorgos
*Assistant Examiner*—Edna Wong
*Attorney, Agent, or Firm*—Banner & Witcoff, Ltd.

[57] ABSTRACT

An anodizing electrolyte containing a polyethylene glycol dimethyl ether and an electrochemical process for anodizing valve metals which permits the formulation of an anodic layer having a substantially uniform thickness and reduced flaw density.

19 Claims, No Drawings

ANODIZING ELECTROLYTE AND ITS USE

BACKGROUND

A. Field of the Invention

This invention relates to an anodizing electrolyte and to an electrochemical process for anodizing valve metals which permits the formation of an anodic layer having a substantially uniform thickness and reduced flaw density.

B. Related Prior Art

The increased numbers and types of electrical equipment has led to a corresponding increase in the need for the efficient formation of anodic films having good integrity. The anodization of tantalum is a case in point.

The demand for electronic circuit capacitors having high volumetric efficiency and reliability combined with low equivalent series resistance and stable electrical properties over a wide temperature range has resulted in steadily increased usage of so-called "solid" capacitors since their introduction in the 1950's. The proliferation of electronic devices employing surface mount technology has raised the world wide consumption level of solid tantalum capacitors to several billion devices per year.

The efficient fabrication of tantalum capacitors from sintered powder-metallurgy tantalum anode compacts requires the use of bulk handling techniques for separation of the anodes from each other after sintering and for processing the anodes through the attachment step in which the anodes are welded or otherwise affixed to bars or other support structure from which the anodes are suspended during anodizing and subsequent process steps. The bulk handling separation and welding equipment generally incorporates vibratory tables, feeder bowls, tracks, etc. to separate and position the anodes for welding.

During bulk handling, vibratory separation and transport the tantalum anode bodies can be subjected to a substantial amount of abrasion and impact against each other and hard machinery surfaces. This abrasion and impact can result in mechanical damage to the anode bodies. The edges and corners of the anodes tend to be most susceptible to damage due to the high concentration of mechanical stress in these areas during handling. Optical and S.E.M. examination reveals that the edges and corners of the anodes may be peened or burnished to the degree that the individual tantalum particles are smeared into a more or less continuous surface locally.

After post-sintering separation and attachment to carrier strips or bars, the anodes are suspended in an electrolyte solution and anodized under appropriate current density to produce the anodic oxide dielectric. The anodizing step may be carried out at a temperature up to about 95° C. in an electrolyte which typically consists of a dilute aqueous or mixed aqueous/ethylene glycol solution of a mineral acid or a salt of a mineral acid such as phosphoric, sulfuric, nitric or hydrochloric acid. Electrolytes which tend to give the best results (i.e. highest dielectric quality) often contain 50–60 vol % ethylene glycol or polyethylene glycol and 0.5 to 2 or more vol. % phosphoric acid and are maintained at a temperature between 80° and 90° C.

Scanning electron microscope examination of the anodic oxide often reveals the presence of flaws in the anodic oxide film particularly at the mechanically damaged portions of the anodes. These flaws have the appearance of a series of ruptured blisters and closely resemble the flaws illustrated in FIG. 9.01, on Page 116 of L. Young's Book, "Anodic Oxide Films" (1961 Academic Press). It has been well established since the 1950's that the flaws in the anodic oxide are the primary pathways for leakage current and are the initiation sites for catastrophic dielectric failure in finished capacitors.

Detailed examination of a large number of anodes conventionally handled and anodized indicates that the oxide flaw density is roughly proportional to the magnitude of mechanical damage done to the anodes and is more than linearly proportional to the anodizing voltage (i.e. anodic oxide thickness). A semi-quantitative evaluation of anodic oxide quality in the mechanically damaged portions of anodes may be made by counting the number of flaws visible in photomicrographs of the oxide surface taken at the same magnification, for example, at 1000×.

One process for the anodizing of valve metals which are difficult to anodize with conventional anodizing technology is described in British Patent Application, GB 2,168,383A. In a preferred embodiment several bars of bulk-handled, mechanically damaged anodes pressed from TU-4D tantalum powder and having a 1000 microcoulomb C.V. product were anodized. A current density of 3 microamperes/microcoulomb or 3 milliamps/anode was employed with an electrolyte containing 90 Vol % N-methyl-2-pyrrolidone and, 10 vol % phosphoric acid (85%). The electrolyte had a 60 HZ resistivity of approximately 35,000 ohm cm at 30° C. and, the anodizing voltage was 239 volts to give an oxide thickness equivalent to that obtained at 200 volts at 85° C. (The voltages required to obtain equivalent oxide thickness at different anodizing temperatures may be calculated from $(T_1)\times(V_1)=(T_2)\times(V_2)$ where V=anodizing voltage and T=absolute solution temperature in Kelvins.) The hold time at voltage was varied from 3 hours to 22 hours.

S.E.M. examination of the anodic oxide revealed an almost complete absence of flaws in the anodic oxide covering the mechanically damaged portions of the anodes. However, due to the very high resistivity (35,000 ohm.cm), the low water content (less than 2½%) and the associated low ionic mobility inside the anode bodies, the anodic oxide was not of uniform thickness on the interior surfaces of the anodes. Although it is possible to reduce the resistivity of the electrolytes described in G.B.2,168,383A through the addition of appropriate amines, it is desirable to avoid the use of amines in large scale manufacturing processes due to the toxicity generally associated with these materials.

SUMMARY OF INVENTION

It is an object of the invention to provide an anodizing electrolyte which permits the efficient formation of an anodic oxide layer having a substantially uniform thickness.

It is a further object of the invention to provide an anodizing process which permits the efficient formation of a substantially flaw-free anodic oxide layer.

It is a still further object of the invention to provide an anodizing process which results in a substantially flaw-free uniform anodic oxide layer even over areas of the underlying metal which have been mechanically damaged.

In accordance with this invention there is provided an electrolyte comprising water, a polyethylene glycol dimethyl ether and phosphoric acid or an electrolyte-soluble salt thereof, said electrolyte having a resistivity below about 5000 ohm cm at 30° C.

In accordance with another aspect of the present invention there is provided a process for anodizing a valve metal comprising conducting the anodization at a temperature below about 50° C. in an aqueous electrolyte containing a polyethylene glycol dimethyl ether and phosphoric acid or an electrolyte-soluble salt thereof, said electrolyte having a resistivity below about 5000 ohm cm at 30° C.

The use of the electrolyte of this invention, even at moderate temperatures, provides an efficient means of forming substantially uniform anodic coating even over portions of the underlying bodies that are damaged. Importantly, the present invention readily permits the formation of substantially flaw-free anodic layers. The electrolyte provides the ability to employ higher currents during anodization which permits the present voltage to be reached more quickly and results in increased production.

DETAILED DESCRIPTION OF THE INVENTION

The electrolyte, according to this invention, contains three essential components: water, a polyethylene glycol dimethyl ether, and phosphoric acid or an electrolyte-soluble salt thereof. The electrolyte permits good flexibility in the choice of anodizing conditions while providing a substantially flaw-free, uniform anodic coating.

The water content of the electrolyte can range from about 25% to about 90% by volume of the solvent component of the electrolyte. The remaining essential component of the solvent component, present in amounts of from about 10% to about 75% by volume, is a polyethylene glycol dimethyl ether (PEGDME). The PEGDME which is employed in this invention is water-soluble, has a low viscosity of less than about 25 cps at room temperature, and has a high boiling point above about 250° C. The PEGDME of this invention may have from 4 to about 10 repeating ethylene oxide units. These PEGDME have high stability, retain their integrity during the anodization process and have low toxicity. The low reactivity of the PEGDME is such that they do not react with the alkali metals below a temperature of approximately 150° C.

The anodizing current tends to concentrate the organic component of the solvent inside the anode. Consequently, low viscosity, low vapor pressure, and high stability are important in permitting the solvent not only to invade the pores of the substrate, but also to conduct heat away during the formation of the anodic film. Polyethylene glycol dimethyl ether has a breakdown voltage of about twice that of the conventionally employed ethylene glycol or polyethylene glycol and has much lower viscosity than ethylene glycol or polyethylene glycol.

The organic solvents traditionally used to anodize tantalum anodes, ethylene glycol and polyethylene glycols, as well as the other solvents mentioned above tend to have serious disadvantages: Ethylene glycol is toxic, 4-butyrolactone undergoes ring cleavage decomposition and, the glycols and polyglycols tend to be viscous at lower temperatures. The higher alkyl ethers of the polyethylene glycols, such as diethyl, dipropyl or dibutyl ethers are not suitable for the practice of this invention because they do not provide the requisite solubility and low viscosity.

The following table compares that properties of tetraethylene glycol dimethyl ether (TEGDME) and those of ethylene glycol:

| | TEGDME | Ethylene Glycol | Polyethylene Glycol 300 |
|---|---|---|---|
| Viscosity, cps at 20° C. | 4.1 | 20.9 | 75 |

Ethylene glycol, the organic electrolyte component commonly used has a vapor pressure at 20° C. over 80 times the vapor pressure of PEGDMES (0.8 mm vs <0.01 mm) and has a lower boiling point (198° C. vs. 275° C.). While polyethylene glycol has a low vapor pressure and high boiling point (eg: 400° C.), its high viscosity is undesirable.

The third essential component of the electrolyte is an orthophosphate ion. The orthophosphate ion is supplied by orthophosphoric acid, although, somewhat less desirably, electrolyte-soluble salts, such as the sodium, potassium, or ammonium salts of phosphoric acid can also be used. The acid salts are preferred among the phosphate salts. Phosphoric acid is preferable to other mineral acids as the ionogen due the greater thermal stability traditionally observed for anodic tantalum oxide containing phosphate incorporated from the electrolyte during anodizing. The phosphate ion will incorporate into the oxide film and result in a more stable oxide film. The incorporated phosphate also will limit diffusion of oxygen from the film into the tantalum substrate, thereby increasing the film dielectric strength at elevated temperatures.

Phosphoric acid electrolytes containing an organic solvent in addition to water are employed in order to raise the sparking voltage of the electrolytes to desired high values in the presence of phosphoric acid concentrations sufficiently high to give a large degree of thermal stability enhancement.

The choice of particular components of the electrolyte and their proportions will depend, inter alia, on process conditions to be employed and is within the skill of the art. For example, the proportion of PEGDME in the solvent generally will increase with increasing voltage used in the anodizing process. For example, for a low voltage of about 75 volts or less, an electrolyte containing from about 10 to about 30% by volume PEGDME desirably will be employed; for an intermediate voltage of from about 40 to about 250 volts, an electrolyte containing from about 20 to about 60% by volume of PEGDME desirably will be employed; and for a high voltage of over about 250 volts, an electrolyte containing about 50 to about 75% by volume of PEGDME desirably will be employed. Such guidance is provided as illustrative only, and is not intended to be limiting for each application.

The concentration of orthophosphate to be employed is also within the skill of the art. In general, between about 1 and about 4.5% by volume of 85% phosphoric acid or its equivalent as a salt will be present in the electrolyte and, most often, preferably, from about 1 to about 2% by volume will be involved. Amounts beyond these ranges can also be employed without departing from this invention.

The resistivity of the electrolyte will depend on the proportion of components. Generally, a resistivity of from about 50 ohm cm to about 5,000 ohm cm will be selected and, commonly, the resistivity will range from about 100 to about 1,000. The electrolyte has a low resistivity which permits complete anodization of pores and internal voids. As one skilled in the art will recognize, the choice of a higher concentration of PEGDME or lower concentrations phosphate content will tend to provide higher resistivities.

The valve metal, which is anodized in accordance with this invention, is a metal of Groups IV or V of the periodic tables including aluminum, niobium, titanium, tantalum and zirconium. Tantalum, niobium, and niobium alloys with titanium, aluminum, or zirconium, including niobium treated with nitrogen, are particularly suitable for anodization in accordance with this invention.

The process of this invention employs a temperature lower than about 50° C. In general, the lower the temperature, the less the tendency to create flaws and, therefore, the process will desirably be operate at as low a temperature as can be economically maintained. While the attributes of the electrolyte of this invention permit the process to be conducted down to the freezing point, the invention will most often be practiced at a temperature in the range of from about 30° to about 40° C. Such temperature range is particularly desirable since it permits the use of water from an evaporation tower to maintain the operating temperature. Additional expensive refrigeration equipment is generally not required for a process operating in the temperature range of from about 30° C. to about 40° C.

The choice of a current density to be used in the practice of this invention is within the skill of the art. By way of illustration, current densities may range from about 1 to about 10 microamps per microcoulomb, and will often be in the range of from about 2 to about 3 microamps per microcoulomb. Voltages used in the anodization may vary from a few volts to well over 250 volts, as is recognized in the art. Indeed, voltages up to over about 400 volts can be employed. Typically, higher voltages will be employed at lower temperatures.

Hold times will obviously vary, depending upon the temperature, voltage, substrate, electrolyte, anodic film thickness, and the like. In general, however, hold times may vary from about 1 to about 20 hours.

This invention can employ known standard equipment and techniques for the anodization. The metal body to be anodized is immersed in a cell in the electrolyte of this invention and connected to the positive pole of the electric current source. Either a constant or a gradually increasing voltage to the cell may be employed to achieve the desired current density. Since the anodization process and the accompanying equipment are well known they will not further be described here.

The advantages of the use of polyethylene glycol ethers of this invention are most pronounced in the following circumstances.

1) The anodes are anodized to relatively high voltages of about 250 volts or more. The ethers have high breakdown voltages and remain stable in such use.

2) The anodes are fabricated from very high surface area powders such as those having surface areas over about 0.5 square meters per gram. The low viscosity of the ethers permits them to penetrate into the pores and dissipate heat effectively.

3) The anodes are fabricated from metals more active than tantalum such as niobium and its alloys with aluminum, titanium, zirconium, hafnium or the like. Such metals give rise to anodic oxides less stable than tantalum oxide. The high electrochemical stability of the ethers of this invention permits efficient use of them in these applications. They will not dissolve the oxide or react with the base metal.

The article which has been anodized as described above may be further subjected to conventional follow-up processing. That processing normally involves washing and heat treating (e.g., 300°–450° C. for tantalum) for about 15 minutes to an hour to saturate the substrate with oxygen. A second anodizing step may also be employed. The purpose of such step is not to grow a new oxide fill, but merely to assure the integrity of the previously grown film. Such second anodizing step should be conducted an elevated temperature, e.g., 80°–90° C., and at a voltage that is less than that used in the required anodizing step (e.g., 10–14% lower).

While the electrolyte has been described in terms of three components, and, indeed, only the above three components are required, nonetheless, other components may be added if desired so long as the important parameters of low viscosity, low vapor pressure and high integrity of the electrolyte are not adversely affected. For example, a minor amount of polyethylene glycol or other water-soluble organic solvent may be employed so long as the viscosity of the combined solvent remains below 25 cps at room temperature and the chemical and vapor pressure stability of the combined solvent is sufficient to avoid the formation of any substantial number of flaws.

The following examples are included for illustrative purposes only, and are not intended to limit the scope of the invention.

EXAMPLE 1

In an effort to determine the pervasiveness of the problem of flaws in the anodic oxide caused by prior mechanical damage to the underlying tantalum surface, a group of anodes was pressed from Cabot TU-4D, a high-quality electron beam melted tantalum powder typically used for higher voltage solid tantalum capacitors. The anodes were designed to have 1,000 microcoulombs (capacitance× voltage ("C.V.")) product and would normally be anodized to about 200 volts for use in 4.7 microfarad/50 volt rated capacitors. These anodes were pressed without any binder to eliminate any potential contamination by binder residues. After the sintering process was completed the anodes were separated and welded to bars on vibratory equipment having stainless steel feeder bowls and other contact surfaces. Sample bars of these anodes were then anodized at 85° C. in an aqueous electrolyte containing about 55% ethylene glycol and about 1.3% phosphoric acid (85%). Various voltages, from 75 to 200 volts were employed. Photomicrographs of the anodic oxide covering the mechanically damaged portions of these anodes taken at 1000× revealed the presence of approx. 5 or 6 flaws per micrograph at 75 volts and well over 100 flaws per micrograph at 200 volts.

E.D.X. and S.I.M.S. elemental analysis of mechanically damaged portions of the anodes and of the flawed oxide after anodization indicated that the blistering of the anodic oxide was not due to the transfer of iron, nickel, or chromium to the damaged portion of the anodes from the stainless steel bulk anode handling equipment. In fact, the elemental analysis of the damaged and undamaged portions of processed and unanodized anode surfaces was very similar. This suggests that the passive oxide film present prior to anodizing may give rise to flaws in the anodic oxide if it is incorporated into the tantalum surface by rough handling.

EXAMPLE 2

A series of anodizing tests was performed in which anodes which were handled with soft plastic tweezers (no mechanical damage) and anodes which were processed through bulk anode handling equipment (mechanically damaged) were anodized together, some in an electrolyte containing about 55% ethylene glycol and about 1.3% phosphoric acid (85%) and an electrolyte containing about 50% polyethylene glycol and about 2% phosphoric acid (85%). The polyethylene glycol used was PEG 300. In each case many oxide flaws or blisters were present in the oxide film covering the damaged portions of the bulk-processed anodes while the oxide fills on the undamaged anodes were nearly flaw-free, i.e. the oxide flaw density at 200 volts was over 100 times higher for the mechanically damaged anodes. This eliminated factors, such as electric field, current density, hold time at voltage, etc., as major contributing factors and demonstrated mechanical damage as the major cause of the oxide flaws in spite of the absence of detectable contamination from bulk handling equipment in most cases.

EXAMPLE 3

A further attempt was made to determine if the mechanically damaged areas of bulk processed anodes gave rise to flawed anodic oxide layers due to the presence of contaminants in the tantalum substrates which are uncovered by mechanical damage (the outer surface of the anodes tends to be purified due to vacuum evaporation of impurities during sintering). Anodes from the lot pressed from TU-4D tantalum powder, described above, were broken, some along the long axes of the anodes and some at right angles to the long axes. These anodes were then anodized to 200 volts in the electrolytes described in Example 2.

Although the anodic oxide covering the mechanically damaged outer portion of the anodes was found to be highly flawed, the anodic oxide covering the broken surfaces of the anodes was found to have very few flaws, indicating that the flaws were not due to impurities in the tantalum uncovered by mechanical damage.

EXAMPLE 4

The structure of the flaws in the anodic oxide covering the mechanically damaged portions of bulk-handled anodes of Examples 1–3 was examined in detail. The flaws were found to be localized and had not spread laterally as sometimes happens with inferior electrolytes such as aqueous nitric acid. Ion milling was used to section some flaws which were then examined with a transmission electron microscope. The flaws had a blister-like appearance. The increased oxide volume in the bodies of the flaws was produced by the consumption of a larger amount of tantalum than in the surrounding oxide. The blister-like flaws extended into the base metal as well as out from the surface of the anodic oxide. Some mechanism was at work, locally, which caused the anodic oxide growth at flaws to continue beyond that of the surrounding oxide, presumably in the production of crystalline (non-electrical barrier) tantalum oxide.

The suitability of the polyethylene glycol dimethyl ethers for use in tantalum anodizing electrolytes is demonstrated in the following examples:

EXAMPLE 5

In order to illustrate the very high ultimate or sparking voltages which are possible with electrolytes based upon polyethylene glycol dimethyl ethers, even at 80°–90° C., a series of electrolytes was prepared containing 50 vol. % organic solvent in de-ionized water with a sufficient quantity of 85% phosphoric acid added to yield a resistivity of approximately 1,000 ohm cm at 85° C. Anodes weighing approx.0.9 gram, pressed from NRC (Starck) QR-12 tantalum powder and vacuum sintered so as to have 2,400 microcoulombs/gram C.V. product were anodized to the breakdown point in each of these electrolytes at a current density of 50 milliamperes/gram. Breakdown or sparking voltage was indicated by a sudden reduction in voltage and violent gassing of the anodes. One anode was tested at a time in 250 ml of electrolyte in a magnetically stirred 250 ml stainless steel beaker:

| Organic Solvent | Breakdown Voltage |
|---|---|
| Ethylene glycol | 240 Volts |
| Polyethylene glycol 300 | 260 Volts |
| Methoxypolyethylene glycol 350 | 285 Volts |
| TEGDME | 500 Volts |

As indicated by the results described above, the use of the polyethylene glycol dimethyl ether, (Tetraglyme manufactured by the Grant Division of Ferro Chemical Co.) gives a large increase in ultimate sparking voltage over the traditional organic solvents used for anodizing tantalum anodes.

EXAMPLE 6

In order to determine the flaw site density in the anodic oxide covering the mechanically damaged portions of anodes processed through vibratory bulk anode handling equipment anodized in a polyethylene glycol dimethyl ether-based electrolyte, bulk-processed 4.7 microfarad/50 volt rated anodes pressed from the TU4D tantalum powder were anodized to 228 volts at 40° C., at a current density of 3 microamperes/microcoulomb in an aqueous electrolytic containing 50 vol % Tetraglyme and 2 vol % phosphoric acid (85%).

The anodic oxide produced in this experiment was equivalent in thickness to that produced at 200 volts at 85° C. 1000× S.E.M. examination of the oxide covering the mechanically damaged portions of the anodes revealed the presence of 1 or 2 flaws per 3½"×4½" standard S.E.M. photograph vs. over 100 flaws per photograph for 200 volt films on anodes from the same lot anodized in an ethylene glycol or polyethylene glycol electrolyte of Example 2 at 85° C.

EXAMPLE 7

In order to determine the flaw initiation resistance of PEGDME-based electrolytes at higher than normal current densities and reduced temperature, several bars of anodes as described in Example 6 were anodized to 228 volts at 40° C. in the electrolyte of Example 6 at 33 microamperes/microcoulomb or about 10 times the current density commonly employed in production anodizing. S.E.M. examination indicated no increase in flaw site density at the higher current density over that observed in Example 6.

EXAMPLE 8

A lot of anodes pressed from Cabot C-250 tantalum powder and processed through vibratory bulk handling equipment was split into two groups before anodizing. One group was anodized to 140 volts at 85° C. in a traditional, 55% ethylene glycol-based electrolyte containing about 1.3% phosphoric acid (85%). The other group was anodized to 160 volts at 40° C. in the electrolyte of Example 6.

The anodes were then processed normally into molded-construction, surface-mount capacitors.

Yield following burn-in 1.32×rated voltage

Traditional, 85° C. Anodizing—93.55%

40° C. Anodizing—98.35%

The reduction in anodic oxide flaw density for mechanically damaged anodes anodized at 40° C. in a polyethylene glycol dimethyl ether-based electrolyte vs traditional, 85° C. anodizing was reflected in higher yields (i.e. lower short-circuit losses) during accelerated life-testing.

What is claimed is:

1. An electrolyte comprising water, a polyethylene glycol dimethyl ether having from 4 to about 10 repeating ethylene oxide units and phosphoric acid or an electrolyte-soluble salt thereof, said electrolyte having a resistivity below about 5000 ohm cm at 30° C.

2. The electrolyte of claim 1 wherein said polyethylene glycol dimethyl ether is tetraethylene dimethyl ether.

3. The electrolyte of claim 2 which contains phosphoric acid.

4. The electrolyte of claim 1 which contains phosphoric acid.

5. The electrolyte of claim 1 which contains from about 10% to about 75% polyethylene dimethyl ether and from about 1% to about 5% of phosphoric acid.

6. The electrolyte of claim 1 which contains from about 1% to about 2% of phosphoric acid.

7. The electrolyte of claim 1 which contains from about 10% to about 30% polyethylene dimethyl ether.

8. The electrolyte of claim 1 which contains from about 20% to about 60% polyethylene dimethyl ether.

9. The electrolyte of claim 1 which contains from about 50% to about 75% polyethylene dimethyl ether.

10. The electrolyte of claim 1 wherein said polyethylene glycol dimethyl ether is tetraethylene glycol dimethyl ether and which also contain phosphoric acid.

11. A process for anodizing a valve metal comprising conducting the anodization at a temperature below about 50° C. in an aqueous electrolyte containing a polyethylene glycol dimethyl ether having from 4 to about 10 repeating ethylene oxide units and phosphoric acid or an electrolyte-soluble salt thereof, said electrolyte having a resistivity below about 5000 ohm cm at 30° C.

12. The process of claim 11 wherein the valve metal is tantalum.

13. The process of claim 11 wherein the valve metal is niobium or a niobium alloy.

14. The process of claim 11 wherein the polyethylene glycol dimethyl ether is tetraethylene glycol dimethyl ether.

15. The process of claim 14 wherein tantalum is anodized in an electrolyte containing tetraethylene glycol dimethyl ether and phosphoric acid.

16. The process of claim 15 which is conducted at a temperature below about 40° C.

17. The process of claim 11 which is conducted at a temperature below about 40° C.

18. The process of claim 11 wherein the polyethylene glycol dimethyl ether is present in amounts of from about 10% to about 75% by volume of the solvent.

19. The process of claim 18 wherein the electrolyte acid contains from about 1% to about 5% of phosphoric acid.

* * * * *